United States Patent [19]

Watanabe et al.

[11] Patent Number: 4,474,193

[45] Date of Patent: Oct. 2, 1984

[54] METHOD AND APPARATUS FOR DIAGNOSIS OF HAIR FOR PERMANENT WAVING

[75] Inventors: Katsuhiro Watanabe, Tochigi; Masayuki Minei, Saitama; Toshio Horikoshi, Tokyo, all of Japan

[73] Assignee: San-Ei Kagaku Co., Ltd., Tokyo, Japan

[21] Appl. No.: 434,861

[22] Filed: Oct. 18, 1982

[51] Int. Cl.[3] ..... A45D 7/00

[52] U.S. Cl. ..... 132/7

[58] Field of Search ..... 132/7, 11 R, 45

[56] References Cited

U.S. PATENT DOCUMENTS

| | | | |
|---|---|---|---|
| 2,235,895 | 3/1941 | Maize | 132/7 |
| 2,265,920 | 12/1941 | Maize | 132/7 |
| 2,808,838 | 10/1957 | Stageberg | 132/7 |
| 3,459,197 | 8/1969 | Wilson | 132/11 R |
| 4,167,869 | 9/1979 | Gikas | 132/11 R |
| 4,398,183 | 8/1983 | Ando | 132/7 |

*Primary Examiner*—Gregory E. McNeill

*Attorney, Agent, or Firm*—Oldham, Oldham, Hudak, Weber & Sand, Co.

[57] ABSTRACT

Disclosed are a method and apparatus for diagnosis of hair for permanent waving, in which the number of untwists of a twisted swatch of hair is counted to measure the waving efficiency, and the result of measurement of the waving efficiency is based to simply select the optimum processing condition for permanent waving which condition has been determined hitherto by relying upon the experience and sense of a beauty artist. The method comprises the steps of imparting twists to a swatch of hair, fixing the hair swatch at its both ends, applying permanent waving to the hair swatch with a waving lotion, releasing one end of the hair swatch in water to measure the number of untwists after processing, evaluating the permanent waving efficiency according to the following formula:

$$\text{waving efficiency} = \frac{\text{number of initial twists} - \text{number of untwists after processing}}{\text{number of initial twists}} \times 100\%$$

and selecting the optimum processing condition for the permanent waving of the specific hair on the basis of the evaluated waving efficiency. The apparatus comprises a hair swatch holding part capable of holding a swatch of hair in a liquid bath while fixing the hair swatch at its both ends, a rotating member disposed on one side of the hair swatch holding part for imparting twists to the hair swatch, a counter part arranged for making interlocking operation with the rotating member, a tension adjusting part disposed on the other side of the hair swatch holding part for adjusting the tension imparted to the hair swatch, and a movable arm to which the hair swatch holding part is connected through the tension adjusting part.

3 Claims, 8 Drawing Figures

METHOD AND APPARATUS FOR DIAGNOSIS OF HAIR FOR PERMANENT WAVING

BACKGROUND OF THE INVENTION

This invention relates to a method of measuring the efficiency of permanent waving applied to human hair and relates also to a method and apparatus used for the diagnosis of the quality of hair on the basis of the result of measurement of the waving efficiency.

The experience and sense of a beauty artist are presently chiefly relied upon for the selction of the waving lotion, determination of the size of the waving rod, determination of the processing time, etc. in applying permanent waving to the hair.

Since, thus, the factors to be definitely determined while primarily taking into account the quality of hair and the desire of a customer are decided on the basis of the experience and sense of a beauty artist, customers have frequently been dissatisfied with the finish, and there have been such cases in which a slight error of the artist's judgment leads to a great trouble.

Such a situation has occurred because there have been no methods and apparatus capable of simply measuring the hair waving efficiency thereby diagnosing the quality of hair. The factor required for the diagnosis of the hair quality is to find out whether permanent waving is easily or difficulty applicable to hair of a customer. For this purpose, permanent waving should be actually applied to the hair of the customer, and the efficiency of permanent waving should be measured.

Various methods of waving efficiency measurement have heretofore been attempted for the principal purpose of evaluating the effect of a waving lotion. Basically, the steps include winding a swatch of hair around a glass rod, applying permanent waving to the hair swatch, removing the hair swatch from the glass rod and examining the resultant shape of the hair swatch. According to such a method, however, the permanent-waved hair swatch becomes three-dimensional, and digitization of the resultant shape for the purpose of accurate evaluation is considerably difficult.

According to a report of Donald H. Kirby in Drug Cosmet. Ind. 80,314 (1957), permanent waving is applied to a swatch of hair in zigzag form, and the waving efficiency is evaluated from the length of the resultant wave having a planar spread. On the other hand, according to a report of Kondo in T. G. Report No. 35 (1959) referring to the method disclosed by John W. Haefele in U.S. Pat. No. 2,615,828, a swatch of hair is wound around a glass rod, and, after application of permanent waving to the hair swatch, the hair swatch is cut on the rod for evaluating the waving efficiency by measuring the diameter of the curl.

The Kirby's method (and its improved method) is now widely employed in this field. However, both of the Kirby's method and the Haefele's method are not reliable in the reproducibility of results and are defective in that the artist's skill is required and numerous measurements must be repeated to enhance the reliability. That is, these methods are not suitable for the judgment of the hair waving efficiency within a short length of time.

SUMMARY OF THE INVENTION

The inventors have made strenuous efforts and studies on such a subject and have discovered that results with high reproducibility can be obtained without requiring the artist's skill when permanent waving is applied to a swatch of hair imparted with twists, and the percentage of fixed twists remaining on the processed swatch of hair is measured to evaluate the waving efficiency. The inventors have also found that, when such a method is used, the quality of hair can be easily or simply diagnosed, so that the optimum condition for permanent waving can be easily set on the basis of the diagnosed hair quality. The present invention is based upon the findings above described. Now, the method and apparatus according to the present invention will be described in detail with reference to the accompanying drawings.

DESCRIPTION OF THE PREFERRED EMBODIMENTS

Figure 1:
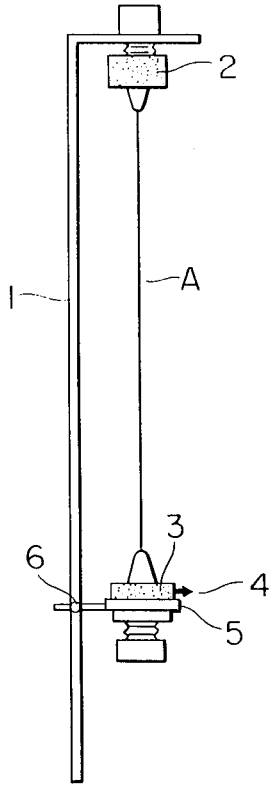
FIG. 1 is a schematic view illustrating the basic principle of the method and apparatus according to the present invention.

Referring now to FIG. 1 schematically illustrating the basic principle of the method and apparatus according to the present invention, a supporting member 1 supports a pair of spaced chucks 2 and 3. The lower chuck 3 is detachably fixed on a seat 5, and an indicator 4 is mounted on this chuck 3 so that the number of revolutions and angular displacement of the chuck 3 can be read. The seat 5 is bertically freely slidable along the supporting member 1 and is fixed at a predetermined position by a set screw 6. The upper chuck 2 is not rotatable although the lower chuck 3 is rotatable.

The symbol A designates a swatch of hair.

In the initial step of an experiment for hair diagnosis, a swatch of hair A is fixed at one end thereof by the upper chuck 2 and at the other end thereof by the lower chuck 3. Then, after rotating the chuck 3 to impart a predetermined number of twists to the swatch of hair A, the chuck 3 is fixed on the seat 5. After applying permanent waving to the hair swatch A by the customary two-liquid method in the above state, the fixed end of the hair swatch A is released from the chuck 3, and the hair swatch A is immersed in water together with the testing equipment. The portions of the hair swatch A not having been subjected to permanent waving are untwisted during immersion in water. Therefore, when the number of untwists is counted, the fixation rate relative to the number of initially imparted twists can be calculated. Thus, the waving efficiency is given by $$\text{waving efficiency} = \frac{\text{number of initial twists} - \text{number of untwists after processing}}{\text{number of initial twists}} \times 100\%.$$

Some examples of experiments conducted according to the method of the present invention will be described to clarify the features of the present invention.

EXAMPLE I

Comparison between the waving efficiency according to the method of the present invention and that according to the Haefele's method Swatches of hair (referred to hereinafter as hair swatches A) of the same person (a woman, 32 years old) were used and had diameters ranging from 60μ to 70μ. The hair swatches A were rinsed with a 0.5% aqueous solution of lauryl sodium suflate and a 30% aqueous solution of methanol. Aqueous solutions of thioglycollic acid of various concentrations adjusted to a fixed pH value of 0.2 (at 25° C.) with ammonia water were used as the first liquid of the waving lotion, and a 5% aqueous solution of sodium bromate was used as the second liquid. The processing steps proceed in the order of 10-minute processing with the first liquid, 1-minute rinsing with flowing water, 10-minute processing with the second liquid, and 1-minute rinsing with flowing water. The processing temperature was maintained constant at 30° C. (In the examples which follow, the processing temperature is 30° C. unless otherwise specified.)

In the case of the method of the present invention, a swatch of hair A about 100 mm long was set between the chucks, and 100 twists were imparted to the hair swatch A under a predetermined load. On the other hand, in the case of the Haefele's method, a swatch of hair A about 200 mm long was wound under application of a predetermined load of about 2 grams while avoiding overlapping of hair portions, and the same steps of processing were done. (Although several swatches of hair were simultaneously processed according to the report of Kondo and the patent of Haefele, such a manner of testing results in large variations of the measured values.)

Figure 2A:
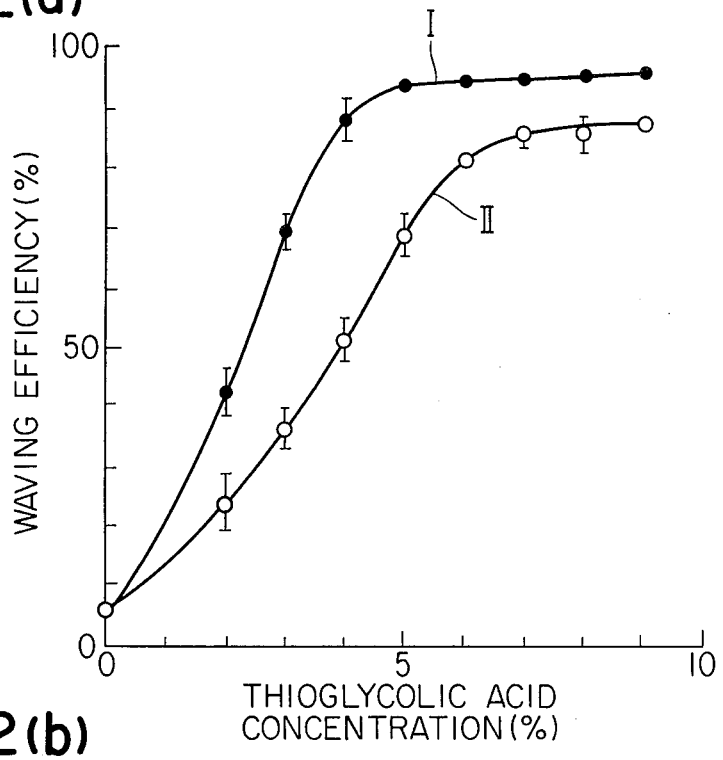
FIG. 2*a* is a graph showing the relation between the concentration of a first liquid (thioglycollic acid) and the waving efficiency according to the method of the present invention.

FIG. 2*a* shows the results of measurement according to the method of the present invention. The curve I in FIG. 2*a* represents the results of measurement of the waving efficiency when the steps of processing with the first liquid and processing with the second liquid continued for 10 minutes in each case. The curve II in FIG. 2*a* represents the results of measurement of the waving efficiency when, after the setps of processing with the first liquid and processing with the second liquid continued for 1.30 minutes in each case, the hair swatches were left to stand for 8.30 minutes in an empty closed vessel. The measurement was done on four swatches of hair in each of the above processing conditions. (The number of swatches of hair subjected to measurement was four in all of the examples which follow.)

Figure 2B:
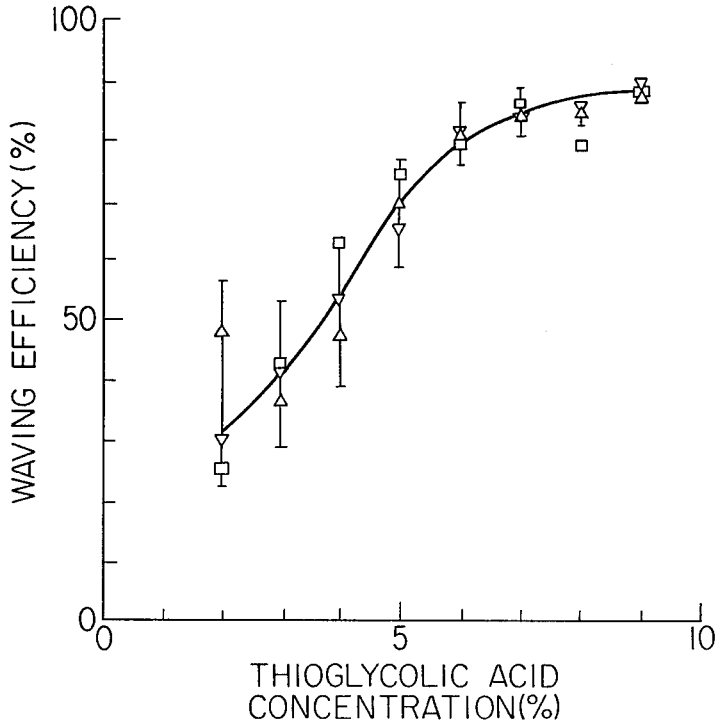
FIG. 2*b* is a graph similar to FIG. 2*a* but showing the relation according to the Haefele's method.

FIG. 2*b* shows the results of measurement according to the Haefele's method when the hair swatches were similarly processed for 10 minutes. The symbols Δ, ▽ and □ indicate the rod diameters of 6 mm, 8 mm and 10 mm respectively. The single curve shown in FIG. 2*b* represents the values of the waving efficiency when the rod diameter was 6 mm. Measurement was done two times for each of the rod diameters. thus, the number of curls is more than 10. It will be seen from comparison between the curve I in FIG. 2*a* and the curve in FIG. 2*b* that the waving efficiency represented by the curve I in FIG. 2*a* is considerably higher than that in FIG. 2*b* although the hair swatches were processed with each of the first and second liquids for the same length of time of 10 minutes. This may be attributable to the fact that, according to the Haefele's method, the portions of the hair swatch in contact with the rod will not satisfactorily react with the waving lotion.

In the case of the method of the present invention too, it can be seen that the results represented by the curve II in FIG. 2*a* are approximately similar to the results of measurement according to the Haefele's method. Yet, the measured values of the waving efficiency in the case of the curve II in FIG. 2*a* are more orderly arranged than those in FIG. 2*b*. The inventors will now make an explanation considered to be convincing. One curl is formed when, after one twist is imparted to a hair swatch placed under tension, the both ends of the hair swatch are brought close to each other. This means that imparation of 100 twists to the hair swatch is equivalent to formation of 100 curls. Thus, the method according to the present invention exhibits such an advantage that the data which is as reliable as that obtained by making measurement on as many as 100 curls according to the Haefele's method and calculating the average value can be obtained quickly by single measurement.

EXAMPLE II

Influence of the length of hair swatches and the number of twists on the waving efficiency The waving efficiency was measured for each of the cases in which swatches of hair A 100 mm long were subjected to 100 twists, 75 twists, 50 twists, 25 twists and 5 twists, and also for each of the cases in which swatches of hair A 50 mm long were subjected to 50 twists and 25 twists, so as to find the influence of the hair length and the number of twists on the waving efficiency. A 6% aqueous solution of thioglycollic acid adjusted to a pH value of 9.2 with ammonia water was used as the first liquid of the waving lotion, and a 5% aqueous solution of sodium bromate was used as the second liquid of the waving lotion. The steps of processing include immersion in each of the first and second liquids for 1.30 minutes and subswquent placement in an empty closed vessel for 6.30 minuites. The results obtained are shown in Table 1. It will be apparent from Table 1 that the values of the waving efficiency are substantially the same within the range of this experiment. That is, it can be seen that the waving efficiently is not dependent upon the length of hair swatches, except that the measured values tend to become slightly larger when the number of twists is smaller. In the examples including the example and following ones, measurement of the waving efficiency according to the method of the present invention was done after imparation of 100 twists to swatches of hair 100 mm long.

TABLE 1

| Hair swatch length (mm) | Number of twists (turns) | Waving efficiency (%) |
|---|---|---|
| 100 | 100 | 80.0 (80–81.5) |
| 100 | 75 | 79.8 (77.3–82.7) |
| 100 | 50 | 80.6 (76–85) |

TABLE 1-continued

| Hair swatch length (mm) | Number of twists (turns) | Waving efficiency (%) |
|---|---|---|
| 100 | 25 | 81.5 (76–85) |
| 100 | 5 | 79.5 (76–87) |
| 50 | 50 | 82.3 (80–84) |
| 50 | 25 | 79.5 (72–84) |

EXAMPLE III

Figure 3:
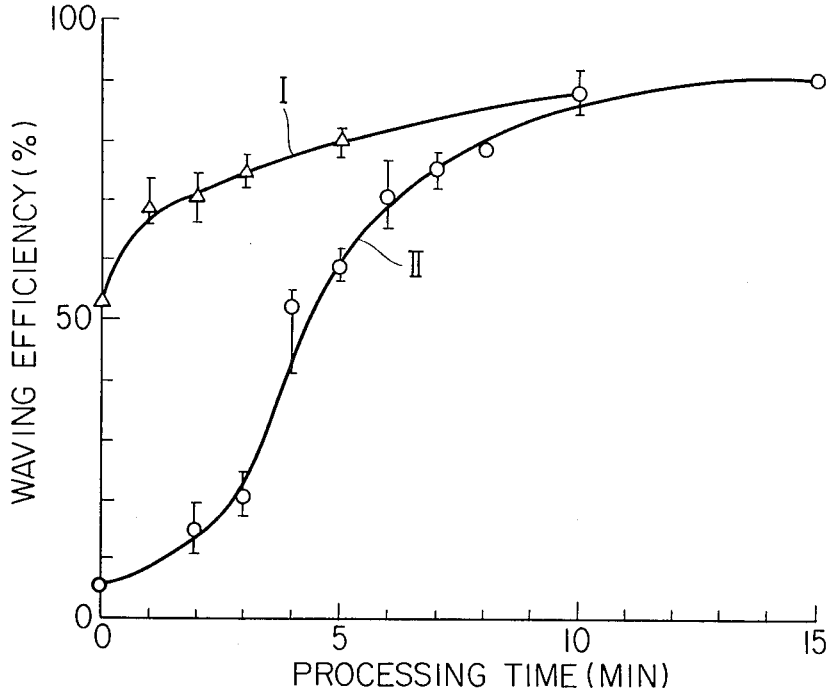
FIG. 3 is a graph showing the relation between the processing time and the waving efficiency.

Influence of the processing time and the second liquid on the waving efficiency FIG. 3 shows the results of an experiment conducted to find the influence of the processing time on the waving efficiency. A 4% aqueous solution of thioglycollic acid adjusted to a pH value of 9.2 with ammonia water was used as the first liquid of the waving lotion, and a 5% aqueous solution of sodium bromate was used as the second liquid of the lotion. Immersion processing was carried out on swatches of hair A.

The curve I in FIG. 3 represents the results of measurement of the waving efficiency when the processing time with the first liquid was maintained constant at 10 minutes, while the processing time with the second liquid was varied as shown on the horizontal axis of FIG. 3. The point corresponding to zero processing time with the second liquid means that 10-minute processing with the first liquid was followed directly by rinsing for 2 minutes with flowing water. It will be apparent from FIG. 3 that the rate of fixation (oxidation) when processing with the second liquid is not done and rinsing with water is only done, is about 60% of the values obtained when processing with each of the first and second liquids is carried out for 10 minutes. In such a case, however, untwisting of the hair portions not having been subjected to permanent waving proceeds considerably slowly, and a considerable length of time is required for measurement. It is preferable therefore that, for the measurement of the waving efficiency according to the method of the present invention, processing with the second liquid be carried out for a predetermined length of time which may be short.

The curve II in FIG. 3 represents the results of measurement of the waving efficiency when processing with the first liquid and processing with the second liquid are carried out for various lengths of time shown on the horizontal axis. It will be apparent from this curve II that the processing time is preferably longer than 5 minutes since the shorter the processing time, the lower is the waving efficiency.

EXAMPLE IV

Influence of the processing temperature

Figure 4:
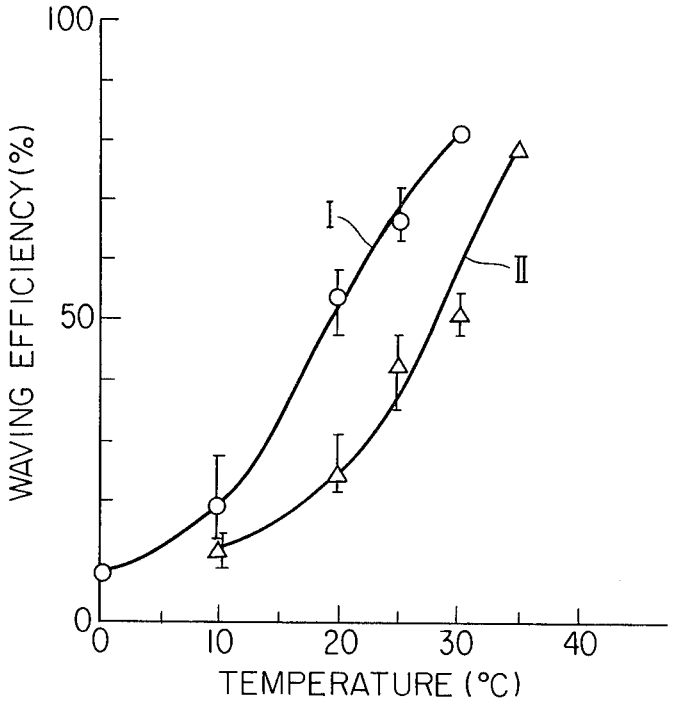
FIG. 4 is a graph showing the relation between the processing temperature and the waving efficiency.

FIG. 4 shows the results of an experiment conducted to find the influence of the processing temperature on the waving efficiency. The curves I and II in FIG. 4 represent the results of measurement of the waving efficiency when the concentration of thioglycollic acid in the first liquid of the waving lotion was 6% and 4% respectively although the pH value was maintained constant at 9.2 (25° C.) in each case. A 5% aqueous solution of sodium bromate was used as the second liquid. The steps of processing included immersion in each of the first and second liquids for 1.30 minutes and placement in an empty closed vessel for 8.30 minutes. It will be apparent from FIG. 4 that the waving efficiency is greatly influenced by the processing temperature. Therefore, a comparative experiment should be conducted under a constant temperature condition.

EXAMPLE V

Diagnosis of hair for permanent waving

The following four kinds of swatches of hair were used in the experiment:

A: a woman, 32 years old, diameter 60μ–70μ

B: the same as A, but processed for 1 hour at 30° C. with a 6% hydrogen peroxide solution having a pH value of 10.0 (ammonia alkaline)

C: a man, 25 years old, diameter 65μ–70μ

D: a man, 34 years old, diameter 80μ–100μ

Table 2 shows the results of measurement of the waving efficiency under different processing conditions. A 6% aqueous solution of thioglycollic acid adjusted to a pH value of 9.2 with ammonia water was used as the first liquid of the waving lotion, and a 5% aqueous solution of sodium bromate was used as the second liquid.

TABLE 2

| Hair swatches | Waving efficiency (%) Processing conditions I | II | III | Diagnosis |
|---|---|---|---|---|
| A | 93.8 (93–94) | 80.9 (80–81.5) | 69.5 (67.5–72) | ± |
| B | 92.9 (92.5–93.5) | 89.8 (89.5–90) | 88.1 (87.3–89) | ++ |
| C | 96.6 (96.5–96.8) | 86.4 (86–87.5) | 77.4 (76–80.5) | + |
| D | 91.2 (90.8–92) | 63.0 (59–65.5) | 53.0 (51.5–58) | −− |

Processing conditions:
I: immersion for 10 minutes in each of the first and second liquids of the waving lotion
II: immersion for 1.30 minutes in each of the first and second liquids and subsequent placement for 8.30 minutes in an empty closed vessel
III: immersion for 1 minute in each of the liquids and placement for 9 minutes
Diagnosis:
++: very easily permanent-waved
+: relatively easily permanent-waved
±: ordinarily permanent-waved
−: relatively difficultly permanent-waved
−−: very difficulty permanent-waved It will be apparent from Table 2 that the difference in the waving efficiency is quite marked in the cases of the processing conditions II and III although the difference is not so marked in the case of the processing condition I in which the swatches of hair are immersed in each of the first and second liquids for 10 minutes. Such a slight difference in the waving efficiency is attributable to a great excess of the so-called bath ratio under the processing condition I. As other factors, the reaction heat generated during processing with the first liquid may slightly raise the temperature, and permanent waving may be applied by initially heating a waving lotion of low concentration. Anyway, it is essentially required that the processing condition be regulated to be as close to the practical condition as possible. When the control of the processing temperature is difficult, whether or not a swatch of hair is easily permanent-waved can be easily diagnosed by processing the swatch of hair in parallel with processing of a predetermined reference swatch of hair.

EXAMPLE VI

Correlation between the results of hair diagnosis according to the method of the present invention and the results of actual application of permanent waving in a beauty salon.

Figure 5:
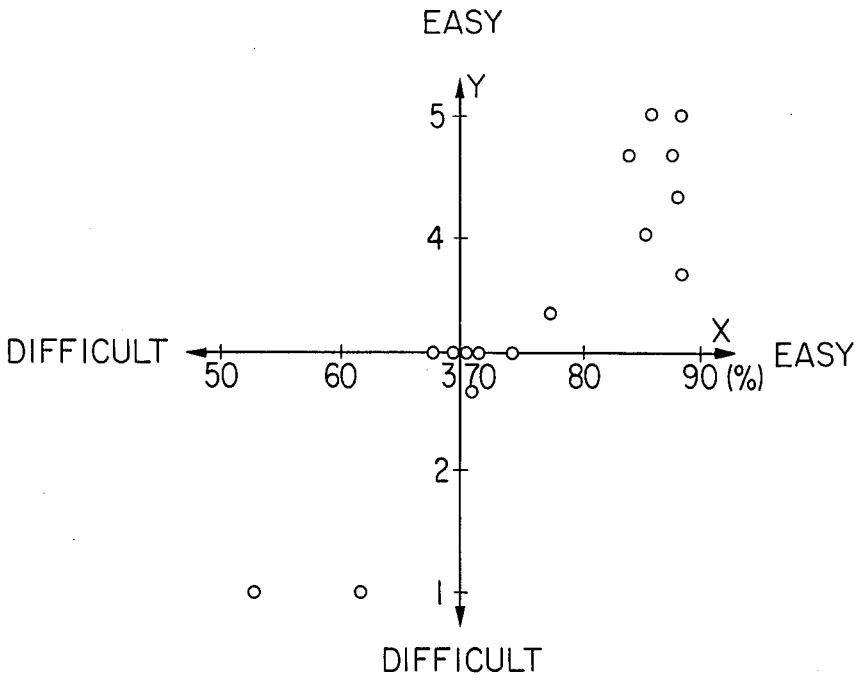
FIG. 5 shows the correlation between the results of hair diagnosis according to the method cf the present invention and the actual results of permanent waving.

FIG. 5 shows the correlation between the results of actual application of permanent waving in a beauty salon and the results of analysis of the quality of swatches of hair diagnosed by the method of the present invention. The X-axis in FIG. 5 represents the waving efficiency measured by the same method as that used for processing under the processing condition II shown in Table 2, and the Y-axis represents the averages of the evaluated values classified into five grades depending on the degree of permanent waving when permanent waving was applied with a commercially available waving lotion by a beauty artist. It will be apparent from FIG. 5 that there is a considerably close correlation between the quality of swatches of hair diagnosed by the mehtod of the present invention and the degree of permanent waving sensed by the beauty artist after actual application of permanent waving.

It will be seen from the results of various experiments above described that the method of the present invention comprises the steps of taking a swatch of hair to be subjected to permanent waving, imparting twists to the swatch of hair, fixing the both ends of the twisted swatch of hair, applying permanent waving to the swatch of hair under a predetermined condition, releasing one end of the permanent-waved swatch of hair in water, measuring the waving efficiency by calculating the rate of fixation of twists on the basis of the number of untwists, and comparing the measured waving efficiency with that of a preselected reference swatch of hair, whereby the condition required for optimum permanent waving can be determined with satisfactory reproducibility by simple equipment and simple manipulation.

Apparatus suitable for practising the above method of the present invention will now be described. The apparatus of the present invention may be any one of the manual type and the automatic type which are common in their fundamental structure.

Figure 6:
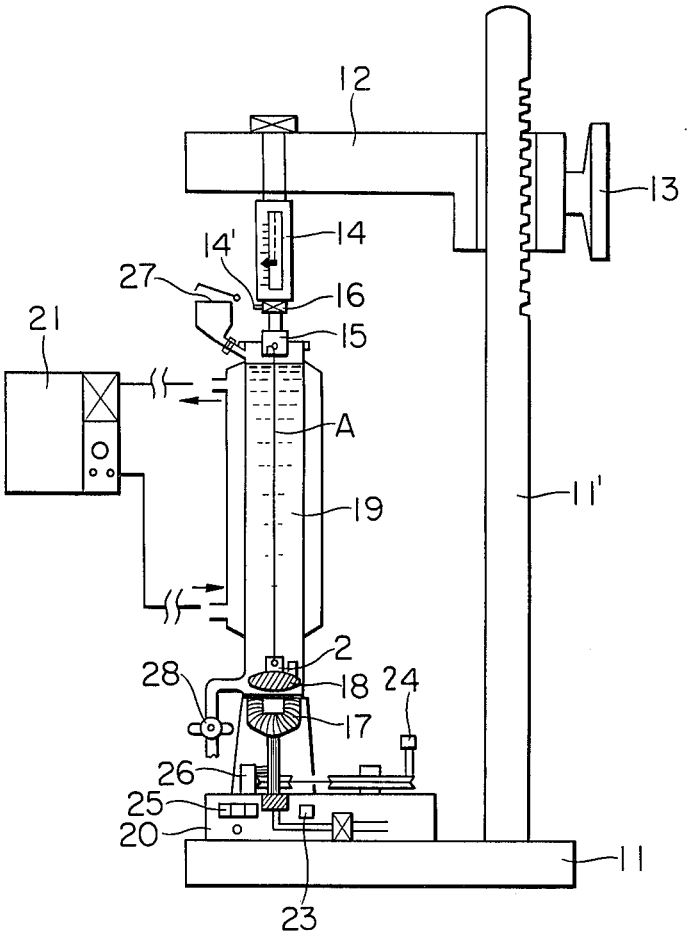
FIG. 6 is a schematic front elevation view of an embodiment of the apparatus according to the present invention which is of the manual type.
Figure 7:
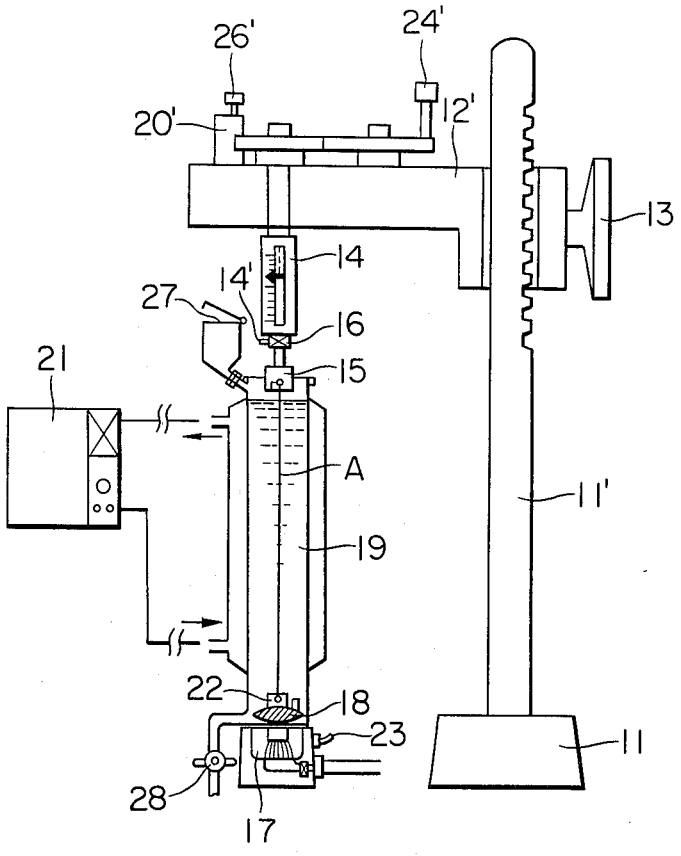
FIG. 7 is a view similar to FIG. 6 but showing a modification of the apparatus shown in FIG. 6.

FIGS. 6 and 7 show two embodiments of the manual apparatus according to the present invention. More precisely, FIG. 6 is a schematic front elevation view of the embodiment in which a swatch of hair is fixed at its upper end and is twisted at its lower end, and FIG. 7 is a schematic front elevation view of the other embodiment in which a swatch of hair is fixed at its lower end and is twisted at its upper end. Each of these embodiments includes a supporting part carrying an arm which is vertically and horizontally movable, a body connected to the arm through a tension adjusting part and including a hair swatch fixing part, a liquid bath and a hair swatch rotating member, and a counter part making interlocking operation with the rotating member.

The structure of former embodiment of the manual apparatus will be described with reference to FIG. 6.

Referring to FIG. 6, a supporting member 11' upstanding from a supporting bed 11 carries at its upper portion an arm 12 which is vertically movable and horizontally slidable by the action of a height adjusting dial 13. A sample (a swatch of hair A) fixing part 16 for fixing one end of the hair swatch A by an upper chuck 15 is connected to the arm 12 through a tension adjusting part 14 such as a spring balance. A liquid bath 19 is mounted on the supporting bed 11, and a rotating member 18 rotated by an electromagnet 17 is disposed in the liquid bath 19. The hair swatch A is stretched under tension in the liquid bath 19 between the upper chuck 15 carried by the hair swatch fixing part 16 and a lower chuck 22 carried by the rotating member 18. Constant-temperature water and a processing liquid or waving lotion are charged into the liquid bath 19 from a constant-temperature water tank 21 and a liquid charging opening 27 respectively during the test for waving efficiency measurement. A counter part 20 is also mounted on the supporting bed 11 for making interlocking operation with the rotating member 18 so that the number of reverse revolutions of the rotating member 18 (the number of untwists of the hair swatch A) can be visually or optically measured or counted.

The process of diagnosis of the quality of the hair swatch A by the apparatus shown in FIG. 6 will now be described.

(a) Water contained in the water tank 21 connected to the liquid bath 19 is set at a predetermined temperature of, for example, 30° C.

(b) A shampooed swatch of hair A longer than 7 cm is taken and held between sheets of dry end paper to remove part of water.

(c) One end of the hair swatch A is fixed by the lower chuck carried by the rotating member 18.

(d) The other end of the hair swatch A is fixed by the upper chuck 15 so that the length of the hair swatch A becomes 5 cm.

(e) The upper chuck 15 is secured to the hair swatch fixing part 16 to stretch the hair swatch A in the liquid bath 19 which is empty.

(f) The arm 12 is suitably moved to set the hair swatch A in a predetermined vertical position.

(g) A switch 23 for energizing the electromagnet 17 is turned on, and a turning handle 24 is manipulated to rotate the rotating member 18 through 50 revolutions while confirming the number of revolutions on a counter scale 25.

(h) The handle 24 is locked by a stopper 26.

(i) The arm-height adjusting dial 13 is turned to adjust the tension until the spring balance 14 indicates a predetermined tension value of, for example, 2 grams on its scale, and the spring balance 14 is locked by a stopper 14'.

(j) A predetermined quantity of a testing liquid A (the first liquid of a waving lotion) whose temperature is controlled to be maintained at a predetermined value of, for example, 30° C. is charged into the liquid bath 19 from the liquid charge opening 27.

The first liquid of the waving lotion is an aqueous solution of, for example, thioglycollic acid, its salts or cystine of suitable concentration adjusted to a pH value of 2 to 11 with ammonia water.

(k) After a predetermined period of time of, for example, 5 to 10 minutes has elapsed, the testing liquid A is discharged from the bath 19 by opening a discharge value 28.

(1) The interior of the liquid bath 19 is cleansed with flowing water, and a predetermined quantity of a testing liquid B (the second liquid of the waving lotion) whose temperature is controlled to be maintained at, for example, 30° C. is charged into the liquid bath 19. The liquid B is discharged after a predetermined period of time of, for example, 5 to 10 minutes.

A solution of an oxidizing agent such as sodium bromate adjusted to a pH value of 2 to 10 is used as the second liquid of the waving lotion.

(m) A predetermined quantity of ion-exchange-treated water maintained at, for example, 30° C. is charged into the liquid bath 19, and the switch 23 is turned off. Immediately after the switch 23 is turned off, the armheight adjusting dial 13 is turned to urge the arm 12 toward a predetermined position (that is, to cause slight upward movement of the arm 12 to permit untwisting of the hair swatch A) and, the number of reverse revolutions of the rotating member 18 is visually or optically counted.

(n) After discharging the ion-exchange-treated water, the hair switch A is removed together with the rotating member 18.

(o) On the basis of the counted number of reverse revolutions of the rotating member 18, the value of the waving efficiency is fetched from a conversion table. (In the case of the optical counting, the waving efficiency is calculated by an arithmetic circuit.)

As described already, the waving efficiency is given by $$\text{waving efficiency} = \frac{\text{number of initial twists} - \text{number of untwists after processing}}{\text{number of initial twists}} \times 100\%.$$

On the basis of the thus calculated value of the waving efficiency, the optimum permanent waving condition is selected from among those previously prepared.

Although the above description has referred to the measurement of the waving efficiency by the manual apparatus shown in FIG. 6 in which a swatch of hair is fixed at its upper end and twisted at its lower end, it is apparent that the manual apparatus shown in FIG. 7, in which a swatch of hair is fixed at its lower end and twisted at its upper end, is similarly used for the measurement of the waving efficiency. The apparatus shown in FIG. 7 is generally similar to that shown in FIG. 6 except that a turning handle 24' and a counter part 20' are disposed above an arm 12'.

Figure 8:
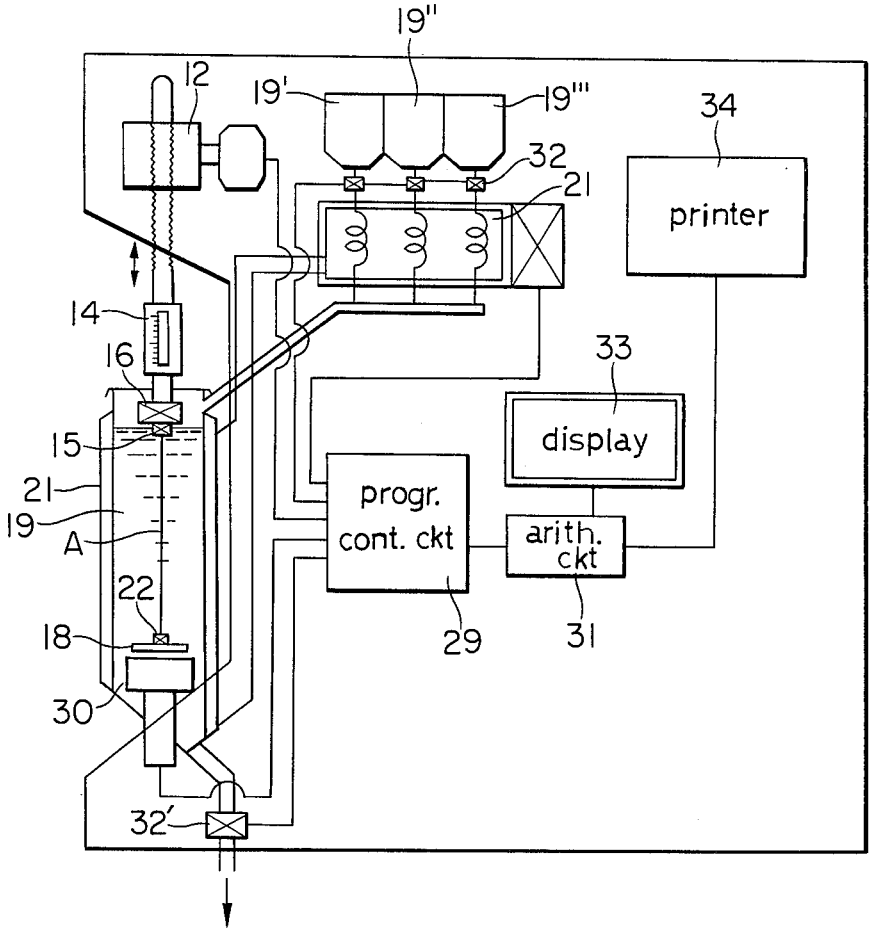
FIG. 8 is a schematic front elevation view, with parts shown by blocks, of another embodiment of the apparatus of the present invention which is of the automatic type.

FIG. 8 shows an automated modification of the apparatus shown in FIG. 6, and, thus, the apparatus has a structure which is fundamentally the same as the latter.

The operation of the automatic apparatus will be descirbed with reference to FIG. 8.

(i) Steps (a) to (f) described with reference to FIG. 6 are executed to set the arm 12 at a predetermined position.

(ii) The start button on a cotnrol panel of a programmable control circuit (PROGR. CONT. CKT.) 29 is depressed to adjust the height of the rotating member 18 at a predetermined level.

(iii) A plurality of electromagnets in an electromagnetic control part 30 are sequentially energized according to a predetermined program to successively shift the rotating magnetic field so that the rotating member 18 makes 50 revolutions at a rotation speed of 60 rpm. Then, all the magnets are energized according to the program, so that the rotating member 18 is locked against rotation.

(iv) Current supplied to the electromagnetic control part 30 is controlled according to the predetermined program to adjust and maintain the tension at 2 grams by the magnetic field.

(v) A solenoid-operated value 32 associated with a liquid tank 19' containing the testing liquid A is opened according to the predetermined program to charge a predetermined quantity of the liquid A maintained at a temperature of, for example, 30° C. into the liquid bath 19. The liquid A is discharged after a predetermined period of time of, for example, 5 minutes.

(vi) Another value 32 is opened according to the predetermined program to similarly charge the testing liquid B from a tank 19'' into the liquid bath 19, and the liquid B is then discharged.

(vii) Another valve 32 is opened to charge a predetermined quantity of the ion-exchange-treated water maintained at a predetermined temperature of, for example, 30° C. from a tank 19''' into the liquid bath 19 according to the predetermined program. As soon as the current supplied to all the electromagents is cut off,, the rotating member 18 is allowed to rotate in the reverse direction. The number of reverse revolutions of the rotating member 18 is detected by sensing a very weak current signal induced in a counter electromagnet (not shown) in the control part 30, and an arithmetic circuit (ARITH. CKT.) 31 calculates the waving efficiency.

(viii) After a solenoid-operated discharge valve 32' is opened to discharge the ion-exchange-treated water, the hair swatch A is remvoed together with the rotating member 18.

(ix) The output signal from the arithmetic circuit 31 indicative of the measured value of the waving efficiency is applied to a display part 33 displaying the measured waving efficiency and is also applied to a data printer part 34 printing the measured waving efficiency data for the specific swatch of hair.

The material of the liquid bath 19 is preferably hard glass. However, it may be a corrosion resistive resin or stainless steel. In the case of the stainless steel, it is preferable to provide a window of a corrosion resistive resin to permit observation of the rotating member 18 therethrough. The rotating member 18 may be a permanent magnet of a magnetic member coated with a corrosion resistive polymer such as Teflon. The electromagnetic control part 30 has preferably a coating of a corrosion resistive polymer.

What is claimed is:

1. A method of diagnosis of hair for permanent waving comprising the steps of imparting twists to a swatch of hair, fixing the hair swatch at its both ends, applying permanent waving to the fixed hair swatch with a waving lotion, releasing one end of the hair swatch in water to measure the number of untwists after processing, and evaluating the permanent waving efficiency according to the following formula:

$$\text{waving efficiency} = \frac{\text{number of initial twists} - \text{number of untwists after processing}}{\text{number of initial twists}} \times 100\%.$$

2. A method of diagnosis of hair for permanent waving comprising the steps of imparting twists to a swatch of hair, fixing the hair swatch at its both ends, applying permanent waving to the hair swatch with a waving lotion, releasing one end of the hair swatch in water to measure the number of untwists after processing, evaluating the permanent waving efficiency according to the following formula:

$$\text{waving efficiency} = \frac{\text{number of initial twists} - \text{number of untwists after processing}}{\text{number of initial twists}} \times 100\%$$

and selecting the optimum processing condition for the permanent waving of the specific hair, on the basis of the evaluated waving efficiency.

3. A method of hair diagnosis as claimed in claim 1 or 2, wherein an aqueous solution selected from the group of solutions of thioglycollic acid, its salts and cystine adjusted to a pH value of 2 to 11 is used as the first liquid of the waving lotion, and an aqueous solution of an oxidizing agent adjusted to a pH value of 2 to 10 is used as the second liquid of the waving lotion.

* * * * *